US005870029A

United States Patent [19]

Otto et al.

[11] Patent Number: 5,870,029

[45] Date of Patent: Feb. 9, 1999

[54] REMOTE MOBILE MONITORING AND COMMUNICATION SYSTEM

[75] Inventors: James C. Otto, Indian Harbor Beach; Brian P. Holt, Melbourne; Arthur L. Stewart, Melbourne Bch., all of Fla.

[73] Assignee: Harris Corporation, Melbourne, Fla.

[21] Appl. No.: 676,503

[22] Filed: Jul. 8, 1996

[51] Int. Cl.[6] ..... G08B 5/22; G08B 23/00

[52] U.S. Cl. ..... 340/825.36; 340/825.31; 340/825.49; 340/573; 379/38

[58] Field of Search ..... 340/825.36, 825.31, 340/573, 825.06, 825.54, 825.49, 572, 539, 568, 525; 379/38

[56] References Cited

U.S. PATENT DOCUMENTS

| | | | |
|---|---|---|---|
| 4,918,432 | 4/1990 | Pauley et al. | 340/573 |
| 5,369,699 | 11/1994 | Page et al. | 379/38 |
| 5,396,227 | 3/1995 | Carrol et al. | 340/825.31 |
| 5,414,432 | 5/1995 | Penny et al. | 342/357 |
| 5,461,390 | 10/1995 | Hoshen | 340/825.49 |
| 5,568,119 | 10/1996 | Schipper et al. | 340/825.37 |
| 5,627,526 | 5/1997 | Belcher et al. | 340/825.49 |
| 5,742,233 | 4/1998 | Hoffman et al. | 340/573 |
| 5,751,245 | 5/1998 | Janky et al. | 340/993 |

*Primary Examiner*—Edwin C. Holloway, III
*Assistant Examiner*—Edward Merz
*Attorney, Agent, or Firm*—Rogerst Killeen

[57] ABSTRACT

A system and method for monitoring the location and/or presence of an object/person within a desired area includes a mobile base station, a central control center, a mobile signaling device carried by the monitored object/person, and a geolocating means. The mobile base station may be transported to an arbitrary site and retains the monitored object/person within a desired area. The central control center determines the acceptability of the location of the monitored object/person and may raise an alarm condition when the monitored object/person is not within the desired area.

26 Claims, 1 Drawing Sheet

REMOTE MOBILE MONITORING AND COMMUNICATION SYSTEM

BACKGROUND OF THE INVENTION

The present invention relates generally to systems for communication with and for monitoring the locations of mobile, remote objects, including people. More particularly, the present invention relates to a system for locating and communicating with the objects (including people) without burdening the monitored object with heavy or bulky communications equipment.

Prior art systems illustrate the various needs for the present invention and that those efforts only partially meet these needs. For example, house arrest systems continuously monitor persons sentenced to remain within a defined, restricted area to assure they do in fact remain within the permitted area. These systems offer continuous oversight but suffer from being able to monitor the offender only at a single fixed location, e.g., his home.

Other prior art prisoner monitoring systems attempt to accommodate the offender sentenced to remain principally within one area but is allowed to travel to a second area during limited times, e.g., the offender must remain at her home except during working hours when she may travel to her place of business. However, these systems are not able to continuously monitor the offender and have limited monitoring areas or distances.

Another type problem exists regarding the need to quickly recover stolen vehicles. Certain type vehicles or assets, known as favorite targets of car thiefs, may have installed vehicle tracking systems. These vehicle tracking systems, powered by the vehicle's battery and not unduly limited in size or transmission power capability, allow authorities to track the location of the vehicle over an extended range and for an extended period of time. Such systems, however, do not notify the owner that the vehicle has been stolen and the vehicle is often transported out of the searchable area or disassembled before the theft is discovered and the recovery system activated. A need is therefore present to promptly notify the vehicle owner that the vehicle has been stolen.

In a similar fashion, an automated notification system is needed to notify the proper authorities when an asset has been moved from a given location. For example, in banks it is known to hide a small explosive device coupled with a permanent dye within one or more bundles of currency. When the dye-carrying bundle is removed from the bank, a signal is provided to the explosive device causing it to detonate, spewing the dye upon the currency and persons nearby. One problem with such devices is the fact that innocent passers-by may be injured by the impact from the explosion and the fact that the thief may become more violent in response to the explosion. Accordingly, it is desireable to use a proximity locating device within such currency bundles. The passage of the proximity device outside the range of a base unit could be made to cause an alarm to be signaled at the appropriate authorities and, if desired, to initiate geolocating the locating device within the currency bundle, all without alerting the thief or causing explosions in the vicinity of potentially innocent persons.

U.S. Pat. No. 4,918,432 to Pauley, et al. for a "House Arrest Monitoring System" illustrates a prior art system wherein the monitored individual's movement is limited to a single fixed area. Pauley, et al. discloses a system comprising an small transmitter in the form of an identification tag which is worn by the monitored individual and which transmits a periodic signal directly to a Field Monitoring Device (FMD) or, if the fixed area has communication dead spots, via a repeater to the FMD. The FMD then communicates to a central, fixed location, e.g., by modem and telephone line, to notify the central location when the monitored individual leaves or re-enters the monitored area. If the monitored individual leaves the fixed area, the central location is not aware of the individual's location. Disadvantageously, no provision is made for the central location to communicate with the individual or the individual to communicate with the central location. Such features are necessary if the system is being used to monitor and communicate with an individual who is under protective custody such that they must be able to freely move about without carrying heavy, bulky equipment and such that they must be in ready contact with central monitoring site to transmit or receive a panic signal.

U.S. Pat. No. 5,461,390 to Hoshen for a "Locator Device Useful for House Arrest and Stalker Detection" illustrates a prior art effort to provide intermittent mobile monitoring of an individual by periodically contacting and determining the location of a locator device attached to the individual in the form of a small transceiver strapped to the individual's leg. The central location initiates a monitoring cycle by transmitting a polling signal, via a wireless, e.g., cellular, system to the locator. Upon receipt of the polling signal, the locator queries a positioning system to ascertain its current location and transmits the location back to the central computer. The central computer then completes the monitoring cycle by comparing the individual's location against database records to determine if the individual is within an authorized location. While this system offers a degree of mobility for the monitored individual, requirements to keep the locator device small and lightweight, mandate compromises in transmission distances and frequency with which the locator can be polled. Therefore, continuous monitoring by the central location and communications at greater distances from the wireless transmission points between the central location and the locator device are not possible.

SUMMARY OF THE INVENTION

Accordingly, it is an object of the present invention to obviate many of the problems and limitations of the prior art.

It is another object of the present invention to provide a novel monitoring and communication system whereby a primary base location may continuously monitor a remote, mobile individual, affixed with a personal transceiver, through indications that the individual is within a defined area around a mobile but determinable location by supplementing the primary base location with a transportable, remote base operably maintaining communications between both the primary base location and the mobile individual.

It is another object of the present invention to provide a novel monitoring and communication system whereby a fixed base location's continuous monitoring a remote, mobile individual is enhanced by the fixed base location selectively varying the size of the defined area within which the mobile individual is monitored.

It is yet another object of the present invention to provide a novel monitoring and communication system utilizing a principal base operatively in contact with a mobile individual through a remote, transportable base transmitting to the principal base information concerning location and proximity of the mobile individual, the degree of proximity selectively adjustable at the transportable base or by the mobile individual.

It is still another object of the present invention to provide a novel monitoring and communication system wherein a mobile individual may communicating with a remote fixed base by causing a mobile, transportable base in close proximity to the individual to transmit a signal to the fixed base. The transportable base may be able to self-determine or to provide signals to assist systems to determine the geolocation of the transportable base (and hence of the mobile individual).

It is a further object of the present invention to provide a novel method for a fixed base monitoring location to communicate with a remote, mobile individual by causing a mobile, transportable base in close proximity to the individual to transmit a signal to that individual.

It is yet a further object of the present invention to provide a novel transportable monitoring base which may determine its own geographic location, maintain communications with a mobile entity in nearby proximity, oversee whether the entity remains within a predetermined range, and communicate this information with a remote, fixed location.

It is still a further object of the present invention to provide a novel transportable monitoring base which maintains communication with a mobile transceiver, oversees whether the transceiver remains within a selectable range, provides its information to a remote, fixed location, and relays information from the fixed location to the transceiver.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
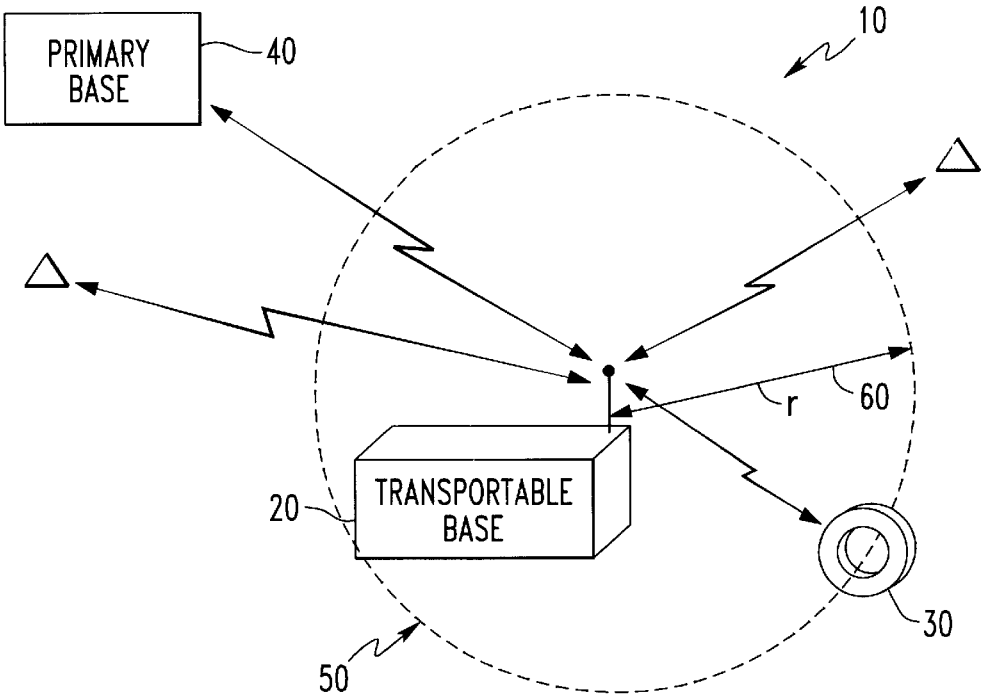
FIG. 1 is a pictorial representation of one embodiment of the system of the present invention.

With reference to FIG. 1, the present invention is illustrated by a preferred embodiment suitable for use as a prisoner monitoring system which monitors the prisoner within a defined area about a mobile but constantly known location and further indicates if the prisoner leaves the monitored area. The system 10 may include three principal, interactive components: a transportable base 20, a prisoner bracelet or tag 30, and a primary control base 40.

The transportable base 20 may include a portable power source which enables the long-term, mobile movement of the transportable base and, accordingly, the prisoner; a geolocating device which enables the system to remain cognizant of the location of the transportable base; a first proximity device cooperatively operating with the prisoner bracelet 30 to monitor whether the prisoner is within the defined monitoring area 50; and a transmitter for continuously communicating with the primary control base its current location and an indication of whether the prisoner is within the defined monitoring area. Thus, by serving intermediate the prisoner bracelet and the primary control base and by remaining in constant communications with both the prisoner bracelet and the primary control base, the transportable base 20 facilitates continuous prisoner monitoring while allowing the prisoner an increased degree of mobility albeit while being electronically tethered to the transportable base.

The prisoner bracelet 30 (or "tag") is affixed to the prisoner in one of several ways known in the art, e.g., by a form-fitting strap to the leg or by close fitting rigid multipiece bracelet around a forearm above the wrist. The bracelet 30 includes a second proximity device operable with the first proximity device of the transportable base 20. The transmission characteristics of the first and second proximity devices jointly define a monitoring distance, "r" 60, between the two devices originating at the transportable base. The area circumscribed about the transportable base by the monitoring distance, "r", determines the monitoring area 50. The monitoring distance 60, and hence the monitoring area 50, is desirably set some amount less than the maximum communication range between the transportable base and the prisoner bracelet.

While the preferred embodiment is described as being used with prisoners, the present invention is by no means limited to such situations and may be used to monitor the location of any mobile persons or objects. For example, the unit could be used to monitor the location of school children on a field trip or outing, with the transportable base being carried in a school bus. In another exemplary embodiment, a system of the present invention can be used to ensure that sentries are properly posted within a predetermined range of an object to be protected. Note that the ability of the transportable base to be moved and to geolocate enhances the usefulness of the invention as the transportable system may be readily established around any area needing security (such as the area surrounding a head of state while on tour.)

Note also that although the described embodiments describe the mobile unit as being housed in a bracelet, many different housings are possible which meet the environmental restrictions of a particular system or location.

The transportable base may include conventional means such as signal strength, doppler effects, phase shifting, radio direction finding, Time Difference of Arrival ("TDOA") and radio frequency ranging for determining the set monitoring distance and the actual distance between itself and the bracelet. The means may, for example, include a monitoring system such as that disclosed in U.S. patent application Ser. No. 055,166, entitled "Proximity Detector Employing Sequentially Generated Mutually orthogonally Polarized Magnetic Fields", by Belcher, et al. filed Apr. 30, 1993 and now abandoned, or in U.S. patent application Ser. No. 315,348, entitled "Proximity Detection Using DPSK Waveform", by Belcher, et al., filed Sep. 30, 1994 now U.S. Pat. No. 5,627,526.

The means for determining monitoring distance described above, generally determine a distance from a receiver but not a location with respect to the receiver. In an alternative embodiment, a system in accordance with the present invention may also include a transportable base unit having a monitoring means which can determine more than the distance a monitored object is from the base station but may also provide information regarding the location and/or relative location of the monitored object from the transportable base unit.

In such an alternative system, sentries in a defined area could be monitored to ensure not only that they have not left the defined area but that they are positioned with respect to one another to avoid "holes" in the perimeter of the monitored area. In such a system, each sentry could carry a mobile unit and be monitored by the transportable unit as to position. The transportable unit or the central unit may use the sentry position information to ensure that the sentries remain on post and have not unwittingly converged in one area, leaving another area unprotected.

Similarly, in an alternative embodiment, the system of the present invention may be used to monitor mobile objects such as automated search equipment. In such an embodiment, the mobile equipment can be affixed, for example, to mobile sensor systems which are used to search a defined territory for a predetermined object. By monitoring the mobile units with the alternative base unit having the ability to locate the mobile units, the user of the system may ensure that the entirety of a given area has been searched.

In a preferred embodiment the transportable base and the prisoner bracelet communicate using an conventional RF scheme and protocol. Alternative means of communications include microwave, radio frequency, spread spectrum, and proprietary RF encoding/decoding schemes.

The primary control base 40, receiving communications from the transportable base, monitors the location of the transportable base and whether the prisoner has left the monitored area. In a preferred embodiment, the transportable base communications, received by the primary control base, consist of a location communication and an affirmative communication that the prisoner is within the monitored area. In an alternative embodiment, the transportable base communications consist of a location communication and a communication only if the prisoner leaves the monitored area. In yet another embodiment, the transportable base only sends location communications when the transportable base is mobile and its location is changing.

Geolocating of the transportable base may use any conventional geolocating technique and may be carried out by the transportable base or by another system. For example, the transportable base may use geolocating navigation satellites, inertial navigation, dead reckoning based on self-contained sensors, or any of the many navigation aids currently available (such as LORAN and/or aircraft systems.) Alternatively, the transportable base may provide a signal or have an identifying characteristic such that other systems can determine the location of the transportable base and communicate the geolocation of the base to the central system. Examples of such systems include the use of a beacon emanating from the transportable unit which can be sensed and geolocated by existing radio receivers such as orbiting satellites or cellular base stations. In such a situation, the sensing unit may use conventional means to report the geolocation of the transportable base to the central location. If needed for a particular application, the transportable unit may be energized while moving, permitting the monitoring system to be operating even though it is not in a fixed location.

In a preferred embodiment the transportable base and the primary control base communicate using RF communications. Alternative means of communications include microwave, radio frequency, spread spectrum, satellite link, computer network, direct digital (ISDN) and/or modulated signals over a telephone link. Generally, it is desirable that such signals between the base unit and the central unit be encrypted or encoded in such a way so that the system cannot be readily fooled or spoofed by intercepting or interfering signals.

As mentioned earlier, in an alternative embodiment, the transportable unit may monitor a plurality of mobile units, such units providing either distance or location information, and each uniquely identifying itself to the transportable unit by conventional means or by the means disclosed in the referenced application by James C. Otto.

The primary control base also includes means for selectively displaying the location of the transportable base and an "out-of-area" alarm for indicating receipt of an indication the prisoner has left the monitored area centered on the transportable base.

Because the bracelet requires only minimal circuitry to communicate with the transportable base and is not burdened with other functions such as geolocating or transmissions back to the primary control base, its power requirements are greatly reduced permitting long battery life in a small and unobtrusive package. Since the transportable base may be located at a convenient distance from the prisoner and may be concealed within an unobtrusive container such as an automobile trunk or a briefcase, the size and power consumption of the transportable base are less critical. The portable power supply may therefor be of convention design and sized to meet monitoring/transmission distance and duration requirements consistent with the specific prisoner monitoring application.

In an alternative embodiment, some of the components described as being in the transportable base may be included in the mobile unit and vice versa and still come within the scope of the present application. For example, the geolocating capability may be contained in the mobile units which relay a relatively low power signal with the geolocation information to the transportable base unit. Because the mobile units communicate with a relatively nearby transportable base unit and not with a remote central unit, the power requirements for this embodiment of a mobile unit may be kept minimal to reduce the need for and weight of a large battery to be carried around by the mobile user.

The afore-described preferred embodiment of the present invention can be modified to accommodate other uses where an individual is desirably monitored from a distant location and additionally communications between the monitored individual and the distant location are necessary.

In such instances, the size of the area may be desirably changed to increase or decrease the distance from the transportable base. The monitored individual would then be allowed to move without setting off an "out-of-area" alarm. As described, by varying the power and transmission characteristics of the first and second proximity devices, the monitoring distance, "r", between the two devices may be varied. To accommodate this, the transportable base may further include means for a local operator to vary the power to or the transmission characteristics of the first proximity device to vary the effective monitoring distance. In this way the monitored individual is provided with either a smaller or larger monitored area. Alternatively, the primary monitoring base may include a transmitter and the transportable base may include a receiving section so that the primary monitoring base may selectively change the monitoring distance by sending a signal to the transportable base.

In another alternative where the monitored individual is provided more information and control, the transportable base may transmit distance information to the bracelet which may include a distance indicator. In this embodiment, the bracelet may include a selector which causes the transmission of signals to the transportable base to selectively change the monitoring distance. the bracelet may further include a "panic button" which, upon depression, transmits a signal to the transportable base, which signal causes the transportable base to send a panic signal to the primary control base. The control base includes an alarm for indicating receipt of the panic signal.

Such a monitoring application may also require that the primary control base quickly contact the monitored individual. The control base may selectively transmit a signal to the transportable base, such signal causing the transportable base to transmit a signal to the bracelet. The bracelet may include a means to receive this signal and an alarm indicating the receipt of the signal.

Figure 2:
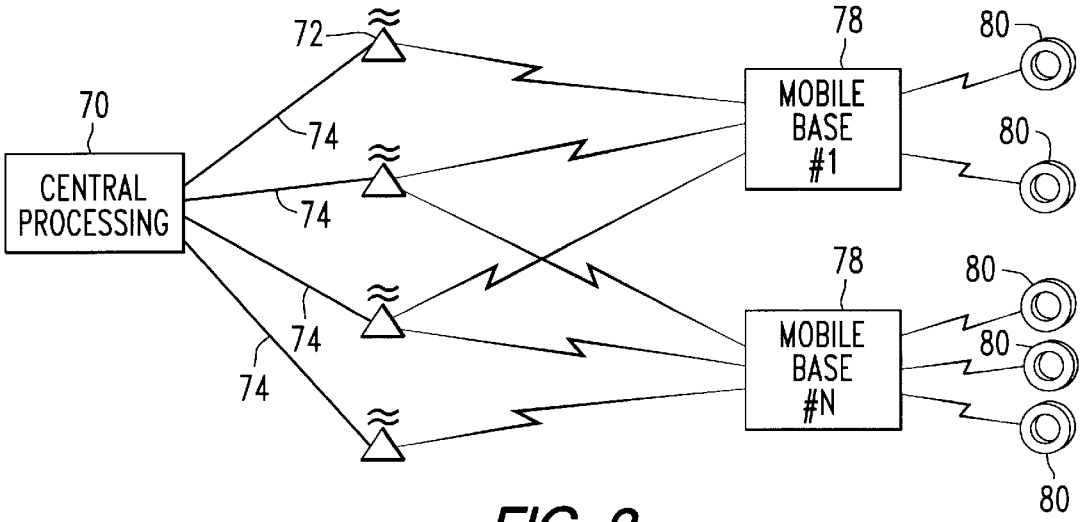
FIG. 2 is a pictorial representation of an alternative embodiment of the system of the present invention.

With reference now to FIG. 2, an alternative embodiment of the present invention may include a central processing unit 70 which communicates with one or more substations 72 via conventional communications links 74. The substations 72 communicate with one or more mobile base stations 78, each of which may be communicating with one or more monitored units 80.

As described earlier, the base stations 78 communicate with the monitored units 80 to ensure that the monitored units 80 remain within a desired proximity to the base station 78. The mobile base stations may determine their own geolocation (such as by a GPS locator) and send information regarding their location to the substations 72 or may provide a signal by which an external device or system may determine and report the geolocation of the mobile base 78 to the substation 72. As the mobile base stations 78 travel from one location to another, the base stations 78 may communicate with different substations 72 so that an entire region, covered by plural substations 72, may be within the permissible travel locations of the base stations 78. As the mobile stations travel from the area of one substation 72 to another, the control of and information regarding the mobile base stations 78 may be passed from one substation 72 to another, under the control of the central processing unit 70.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A system for monitoring an entity's location and for indicating that the entity has left a defined area around the location, the system comprising:

a mobile base for establishing a center from which the defined area is defined, said base comprising, a portable power source so that said base may be transported, first proximity means for indicating that the entity has left the defined area, and means for transmitting the location of said base determined by a geolocating device and the indication that the entity has left the defined area provided by said first proximity means;

a tag for being carried by the entity comprising second proximity means operable with said first proximity means for setting a size of the defined area and determining that the entity has left the defined area; and, said geolocating device for determining a location of said base and for providing the location to said base; and, a control center for monitoring the location of said base and for providing an indication that the entity has left the defined area, said control center comprising, means for receiving transmissions from said base, means for selectivity displaying the location of said base, and an alarm for indicating receipt of the indication that the entity has left the defined area.

2. The system of claim 1 further comprising means for selectively varying the size of the defined area set by said first and second proximity means from said control center.

3. The system of claim 1 further comprising means for selectively varying the size of the defined area set by said first and second proximity means from said base.

4. The system of claim 1 further comprising means for selectively varying the size of the defined area set by said first and second proximity means from said tag.

5. The system of claim 1 wherein said means for transmitting and said means for receiving comprise a computer network.

6. The system of claim 1 wherein said base further comprises a means for determining the distance between said base and said tag.

7. The system of claim 6 wherein said base furthers comprises a means for transmitting the distance between said base and said tag to said tag, and said tag further comprises a means for indicating said distance to allow said entity carrying said tag to monitor the distance between said base and said tag.

8. The system of claim 1 wherein said tag further comprises means for selectively causing said base to transmit to said control center to allow said entity to signal said control center.

9. The system of claim 8 wherein said control center further comprises an alarm for indicating receipt of said signal transmission initiated by said entity and said base further comprises an alarm for indicating the tag has initiated a signal transmission to the control center.

10. The system of claim 1 wherein said control center further comprises means for selectively causing said base to transmit to said tag to allow said control center to signal said entity carrying said tag and said tag further comprises an alarm for indicating receipt of said signal transmission initiated by said control center.

11. The system of claim 1 wherein said geolocating device is at said mobile base.

12. A system for ascertaining whether an entity is within a defined area centered on a mobile base, said mobile base comprising:

a portable first power source so that said base may be transported, a geolocating device for determining the present location of said base, first proximity means for ascertaining whether the entity is within the defined area, said first proximity means being operable with a second proximity means carried by the entity for setting a size of the defined area and ascertaining whether the entity is within the defined area; and means for transmitting the location of said base determined by said geolocating device and an indication of whether the entity is within the defined area provided by said first proximity means.

13. The system of claim 12 further comprising a control center for monitoring the location of said base and for providing an indication that the entity is not within the defined area, said control center comprising, means for receiving transmissions from said base, means for selectively displaying the location of said base, and an alarm for indicating receipt of the indication that the entity is not within the defined area.

14. The system of claim 12 wherein said control center further comprises means for varying the size of the defined area set by said first and second proximity means.

15. The system of claim 12 wherein said base further comprises means for varying the size of the defined area set by said first and second proximity means.

16. The system of claim 12 further comprising a second power source to provide said base with an alternative power source.

17. The system of claim 12 wherein the base further comprises an alarm activated upon the first proximity means ascertaining the entity is not within the defined area and a means for transmitting a notification signal to the second proximity means.

18. The system of claim 17 wherein said means for transmitting a notification signal to said second means is responsive to said first proximity means.

19. The system of claim 17 wherein said means for transmitting a notification signal to said second means is responsive to said base.

20. The system of claim 17 wherein said means for transmitting a notification signal to said second means is responsive to said control center.

21. The system of claim 12 wherein said first proximity means includes a means for determining the distance between said mobile base and said second proximity means.

22. A remote monitor operating with a central site and a mobile transceiver to provide supervising and communicating functions, the remote monitor comprising:

a portable power source so that said monitor may be mobile;

a communication section comprising, means for receiving information concerning the location of said monitor, means for transmitting information to and receiving information from said central site, means for transmitting information to and receiving information from said transceiver;

a processing section comprising, means for determining the location of said monitor from said information concerning the location of said monitor and for causing said communication section to transmit said location to said central site to allow the central site to supervise said monitor's location, means for operably transmitting information to and receiving information from said transceiver and therefrom determining the distance between said monitor and said transceiver in order to supervise the distance between said monitor and said transceiver, means for determining the status of said transceiver from information received from said transceiver in order to permit said transceiver to communicate status reports to said monitor, means operable with said transceiver for setting a reference distance between said monitor and said transceiver in order to establish a distance of supervision between said monitor and said transceiver, means for establishing whether said transceiver is located within said reference distance and for causing said communication section to transmit said information to said central site so that said monitor may communication whether said transceiver is within said established distance of supervision with said central site.

23. The monitor of claim 22 further comprising an alarm section operably connected to said processing section, wherein the a first alarm activates responsive to the processor section determining the transceiver is not within said distance of supervision.

24. The monitor of claim 22 wherein the processor section further comprises a selectably enabled means to cause the communications section to send a signal to said transceiver upon determining said transceiver is not within said distance of supervision in order to communicate to said transceiver the distance between said transceiver and said monitor has exceeded said distance of supervision.

25. The monitor of claim 22, wherein the processor section further comprises means for causing the communication section to transmit said transceiver status reports to said central site.

26. The monitor of claim 22, wherein, upon the central site sending a message that it desires to communicate with the transceiver, the processor section further comprises means for determining the nature of said message and for causing the communication section to transmit said nature of said message to said transceiver.

* * * * *